US006095643A

United States Patent [19]

Cook et al.

[11] Patent Number: 6,095,643

[45] Date of Patent: Aug. 1, 2000

[54] REFILLABLE DISPOSABLE INKJET CARTRIDGE WITH FOAM-FILLED AND FREE INK RESERVOIRS

[75] Inventors: William Paul Cook; Gary Allen Denton, both of Lexington, Ky.

[73] Assignee: Lexmark International, Inc., Lexington, Ky.

[21] Appl. No.: 09/074,215

[22] Filed: May 7, 1998

[51] Int. Cl.[7] ..... B41J 2/175

[52] U.S. Cl. ..... 347/87

[58] Field of Search ..... 347/84, 85, 86, 347/87, 92

[56] References Cited

U.S. PATENT DOCUMENTS

| | | | |
|---|---|---|---|
| 4,794,409 | 12/1988 | Cowger et al. | 347/87 |
| 4,831,389 | 5/1989 | Chan | 347/86 |
| 5,367,328 | 11/1994 | Erickson | 347/7 |
| 5,369,429 | 11/1994 | Erickson | 347/7 |
| 5,486,855 | 1/1996 | Carlotta et al. | 347/87 |
| 5,509,140 | 4/1996 | Koitabashi et al. | 347/86 |
| 5,619,238 | 4/1997 | Higuma et al. | 347/86 |
| 5,621,446 | 4/1997 | Tanka et al. | 347/85 |
| 5,623,291 | 4/1997 | Morandotti et al. | 347/7 |
| 5,629,727 | 5/1997 | Erickson | 347/85 |
| 5,682,189 | 10/1997 | Takagi | 347/87 |
| 5,686,947 | 11/1997 | Murray et al. | 347/85 |
| 5,704,403 | 1/1998 | Svhwenk et al. | 141/18 |
| 5,742,309 | 4/1998 | Tajima et al. | 347/86 |
| 5,742,311 | 4/1998 | Koitabashi et al. | 347/86 |
| 5,742,312 | 4/1998 | Carlotta | 347/87 |
| 5,790,157 | 8/1998 | Higuma et al. | 347/85 |
| 5,805,188 | 9/1998 | Nakajima et al. | 347/87 |
| 5,821,964 | 10/1998 | Bidwell | 347/86 |

FOREIGN PATENT DOCUMENTS 0 719 646 A2 7/1996 European Pat. Off. .

*Primary Examiner*—N. Le
*Assistant Examiner*—Anh T. N. Vo
*Attorney, Agent, or Firm*—B. Franklin Griffin, Jr.

[57] ABSTRACT

A refillable cartridge for inkjet printing devices having an ink supply off-board the cartridge carrier is characterized in that it is filled with an ink supply prior to shipment and the refill opening through which replenishment ink is supplied during printing is left open during shipment and storage. The interior of the cartridge is partitioned into a free ink reservoir, a foam-filled ink reservoir and an air buffer region. The foam-filled ink reservoir is filled with a foam material saturated with ink prior to shipment. A portion of the foam material extends into the air buffer region and is left dry. As long as the refill opening is not closed, ambient pressure is applied to the ink supply in the cartridge via the refill opening and the air buffer region. An ink passage permits ink flow in either direction between the free ink reservoir and the foam-filled ink reservoir. Either reservoir may be connected to ink capillaries in a conventional heater chip. The capillaries provide a greater resistance to ink flow than the foam material so that changes in temperature and/or pressure merely change the level of ink in the foam material.

20 Claims, 2 Drawing Sheets

REFILLABLE DISPOSABLE INKJET CARTRIDGE WITH FOAM-FILLED AND FREE INK RESERVOIRS

FIELD OF THE INVENTION

The present invention relates to a disposable ink cartridge for use on inkjet printing devices of the type having an ink supply located off-board the printhead carrier for continuously replenishing ink in the cartridge via a siphon system. The cartridge has an air buffer region, a free ink reservoir and a foam-filled ink reservoir arranged such that the cartridge may be filled, primed and tested prior to shipment from the factory.

BACKGROUND OF THE INVENTION

The assignee of the present invention currently manufactures an ink cartridge for use 0n wide format inkjet plotters having a large off-carrier ink supply and an ink supply hose through which ink is siphoned from the off-carrier supply to continuously replenish an ink reservoir in the cartridge. The cartridge ink reservoir has an opening extending through the female part of a Luer-Lock fitting. The ink supply hose is connected to one end of an opening in the male part of the fitting and an elongated hollow needle extends from the other end of this opening. When the cartridge is installed on the printhead carrier and the two parts of the fitting are mated, ink is siphoned from the off-carrier ink supply into the cartridge reservoir to replace ink drawn from the cartridge reservoir during printing.

The presently used cartridge has a disadvantage in that it can not be filled and tested prior to shipment from the factory. If the opening into the ink reservoir is left open, ink leaks from the cartridge during shipment and storage. On the other hand, the opening can not be closed by a temporary cap because changes in the ambient temperature or pressure during shipment or storage either causes air bubbles to be drawn into the cartridge through apertures in the nozzle plate, or causes ink to be forced from the apertures. Therefore, the presently manufactured cartridges are shipped empty and untested from the factory. Prior to use, the customer must fill, prime and test the cartridges. The process is messy, error prone and costly in that many cartridges fail to print properly.

SUMMARY OF THE INVENTION

An object of the present invention is to provide a refillable inkjet cartridge suitable for use with a siphon type ink replenishment system, the cartridge being characterized in that it may be filled with ink, primed and tested prior to shipment from the factory.

Another object of the invention is to provide a refillable ink cartridge for an inkjet printing device, the cartridge comprising a cartridge body having therein partitions dividing the interior of the cartridge into a free ink reservoir containing free ink, a foam-filled ink reservoir and an air buffer region, a first of the partitions having an ink passage therein permitting ink flow between the foam-filled ink reservoir and the free ink reservoir in either direction, the cartridge body having a refill opening therein connecting the air buffer region to ambient environment, a hydrophobic foam material within the cartridge, a first portion of the foam material being in the foam-filled ink reservoir and saturated with ink, a second portion of the foam material being dry and positioned in the air buffer region so that ambient pressure is applied to ink in the foam-filled ink reservoir through the dry foam material as long as the refill opening is open.

A further object of the invention is to provide a cartridge as described above wherein the cartridge body has a second opening for permitting the flow of ink from one of the reservoirs to ink capillaries associated with an ink-ejecting heater chip secured to an outside surface of the cartridge body, the ink capillaries providing a greater resistance to ink flow than the foam material. The second opening opens into a stand pipe which may be located in either the free ink reservoir or the foam filled ink reservoir, An ink cartridge according to the invention comprises a cartridge body having an interior partitioned into a free ink reservoir, a foam-filled ink reservoir having ink-saturated foam material therein, and an air buffer region, the partition between the reservoirs having an ink passage permitting ink flow in either direction between the reservoirs. A part of the foam material extends into the air buffer region and this part of the foam material is left dry. A refill opening admits ambient pressure to the air buffer region and the foam-filled ink reservoir as long as the refill opening is not closed. A second opening in the cartridge body permits air to be sucked from one of the reservoirs to ink capillaries in a heater chip during printing. The capillaries provide a greater resistance to ink flow than the foam material so changes in pressure and temperature merely cause the level of ink in the foam-filled ink reservoir to rise or fall when the refill opening is not closed.

A hollow needle is inserted through the refill opening and into the free ink reservoir to allow ink to be sucked from an off-board ink supply to replenish ink used during printing. The needle is attached to a fitting which closes the refill opening, thereby permitting the suction to develop.

A pierceable barrier in the form of an elastic septum is provided in a partition separating the air buffer region and the free ink reservoir. A needle guide is mounted on this partition for guiding a needle, inserted into the refill opening, through the barrier and into the free ink reservoir.

Other objects and advantages of the invention and the manner of making and using it will be obvious upon consideration of the following description and the accompanying drawings.

DESCRIPTION PREFERRED EMBODIMENTS

Figure 1:
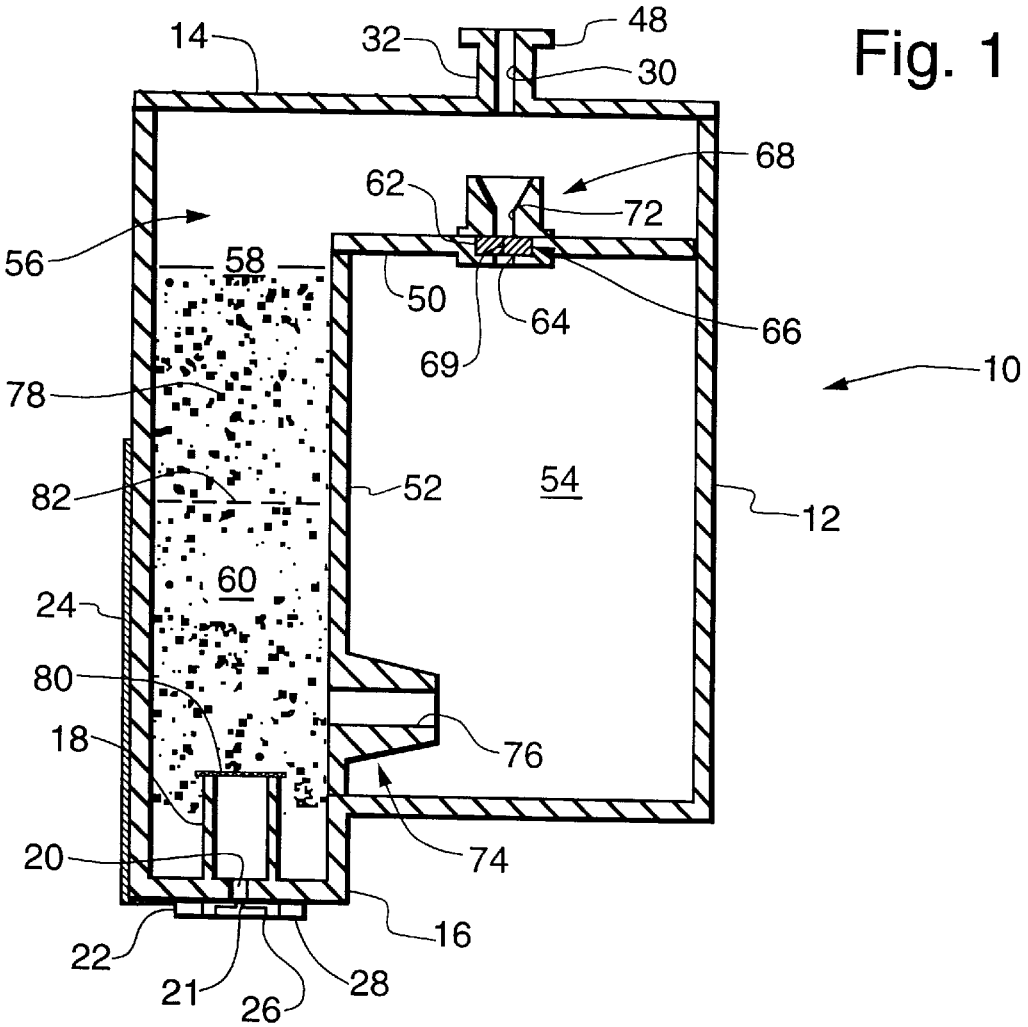
FIG. 1 is a sectional view of a first embodiment of the invention wherein ink is drawn from a free ink reservoir through a foam-filled ink reservoir during printing.

FIG. 1 shows a ready-to-use ink cartridge 10 suitable for use in a printer or plotter wherein ink is siphoned from an ink supply or reservoir located off-board the cartridge carrier. The ink cartridge 10 is conventional in that it comprises a hollow plastic cartridge body 12 having a top cover wall or lid 14. Cartridge body 12 is molded so as to have a downwardly extending nose portion 16 and a stand pipe 18 extending upwardly from the bottom of the nose portion. The cartridge 10 has a first opening 20 extending through the nose portion 16 of body 12. This opening serves as an ink passage which permits the flow of ink from the bottom of stand pipe 18 to capillary ink passages 21 in a heater chip 22. A tab circuit 24 on the exterior of body 12 carries printed circuits which connect heaters in the heater chip to a source of energizing signals when the cartridge is mounted on a cartridge carrier. As the heaters are energized, ink is ejected from the capillary ink passages through nozzles or apertures 26 in a nozzle plate 28 to cause printing. The heaters cool when the energizing signals terminate and this draws ink into the capillary ink passages from the stand pipe through the ink passage 18.

Figure 2:
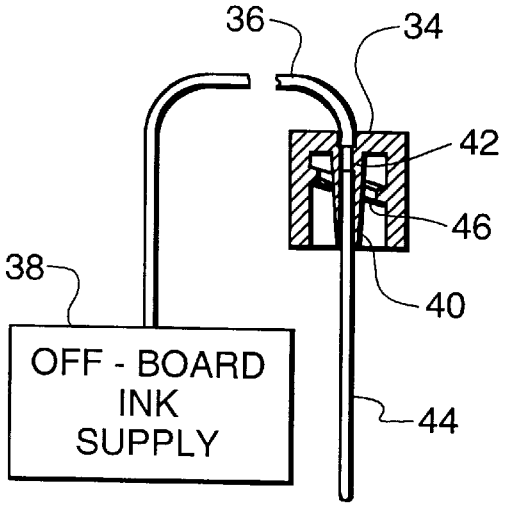
Fig. 2 (PRIOR ART)
FIG. 2 shows a prior art hose and fitting for connecting an off-carrier ink supply to a refillable cartridge, the fitting being shown in section.

The lid or top wall 14 is provided with the male part of a Luer-Lock fitting 32 and cartridge 10 has a second or refill opening 30 extending through the fitting. Fitting 32 mates with the female part of a Luer-Lock fitting 34 (FIG. 2). Fitting 34 is attached to the end of a flexible ink supply hose 36 which provides a continuous supply of ink from a relatively large ink supply 38 that is located in the printing device off-board the cartridge carrier and at a position lower than that of the cartridge.

Fitting 34 has a center projection 40 and a through-hole 42 extends through the projection. A blunt tipped needle 44 is pressed into through-hole 42 from one side and the hose 36 is pressed into the through-hole from the opposite side so that ink may flow from the supply hose 36 through the needle into a cartridge when fittings 32 and 34 are connected. The fitting 34 has a thread 46 and the fitting 32 on the cartridge body is provided with a thread 48 for engaging thread 46.

In accordance with the present invention, a first partition 50 and a second partition 52 divide the interior of body 12 into a first chamber or free ink reservoir 54 and a second, L-shaped chamber 56, the second chamber 56 having an air buffer region 58 and a second region 60, called the foam-filled ink reservoir because it is filled with a foam material that is saturated with ink as subsequently described. The partitions are preferably molded from the same plastic material as cartridge body 12. After the body and partitions are separately formed, the partitions are attached to the cartridge body, preferably by heat staking.

The first partition 50 is provided with a recess 62 and a hole 64 extending through the partition from the bottom of the recess. A pierceable barrier in the form of a septum 66 is disposed in the recess and is held in place by a needle guide 68 secured to the upper surface of the partition. Septum 66 may be made of rubber or another material having sufficient elasticity to reclose a pierced opening 69.

The needle guide 68 has a through-hole 72 which is axially aligned with hole 64 and with the refill opening 30 provided in the cartridge lid. Through-hole 72 widens out toward refill opening 30 so that when a blunt needle 44 is inserted downwardly through the refill opening it is guided into the through-hole so as to pass through the septum 66 and into the free ink reservoir 54.

The second partition 52 is provided with an air guard 74 in the form of a boss projecting into the free ink reservoir 54. An ink passage 76 extends through the air guard to permit the flow of ink between the free ink reservoir 54 and the foam-filled ink reservoir 60. The purpose of the air guard is described later. The ink passage 76 is positioned so that ink from the free ink reservoir 54 enters the reservoir 56 in a region near the top of stand pipe 18 when printing is taking place.

A conventional hydrophobic foam material 78 which may, for example, be unfelted polyurethane open cell foam, is placed in the portion of chamber 56 which extends vertically. Prior to placing the foam material in the chamber, a fine mesh screen 80 is placed over stand pipe 18 to prevent small particles of the foam material from migrating through the stand pipe 1 8 and passage 20 to cause blockage of ink flow through the capillary ink passages 21 in the heater chip. Because of the difficulty in placing the foam material 78 around the stand pipe 18, the material may not extend to the bottom of stand pipe 18. However, it is essential that the foam material extend downwardly to a level below the top of the stand pipe.

After the foam material 78 has been placed in chamber 56, and before the lid 14 is fixed to cartridge body 12, a needle (not shown) is inserted into the foam material from the top and ink is injected to saturate the foam material and fill the stand pipe 18 with ink from an ink supply (not shown). A slight negative pressure is applied to the apertures 26 in nozzle plate 28 at this time to prime the cartridge by drawing ink into the capillary ink passages in heater chip 22.

The foam material 78 is not completely saturated with ink. Only enough ink is injected to saturate the layer of foam material in reservoir 60 up to a level indicated at 82. The layer of foam material above the level 82 and extending into the air buffer region 58 is left dry. This prevents leakage of ink from reservoir 60 to the exterior of the cartridge through refill opening 30 during shipment and storage. If any ink should seep through the dry foam material it will evaporate, because of its fast drying property, before it reaches the refill opening 30.

The free ink reservoir 54 may be filled at the same time that reservoir 60 is filled. Reservoir 54 is filled with ink through a needle inserted into the reservoir through septum 66. Preferably, reservoir 54 is not completely filled so that a small amount of air remains in the reservoir.

After the reservoirs 54 and 60 have been filled, the top cover 14 is heat staked or otherwise secured to the cartridge body 12. The filled and primed cartridge is then ready for testing and shipment. Testing of the cartridge draws a small amount of ink from reservoir 60 and this ink is replaced by air entering the reservoir though refill opening 30.

The purpose of air guard 74 is to extend the ink passage 76 into reservoir 54 so that air in reservoir 54 does not enter the passage even when the cartridge is oriented such that the reservoir 60 is above the reservoir 54, as might occur during shipment or storage.

The refill opening 30 should not be completely closed until it is connected to the offcarrier ink supply of a printing device. By leaving refill opening 30 open, ambient pressure is applied to the ink supply in the reservoirs 54 and 60 so that changes in conditions (pressure and/or temperature) tending to create a pressure difference between the ambient pressure and the pressure in the reservoirs do not adversely affect cartridge 10. For example, if the ambient pressure decreases or the temperature of the ink in the reservoirs rises, the only effect is that a small quantity of ink in reservoir 54 moves through ink passage 76 and the level of ink rises in reservoir 60 as air escapes through refill opening 30. Ink is not forced from the cartridge through capillary ink passages 21 and apertures 26 because the capillary passages provide a greater resistance to ink flow than the foam material 78. On the other hand, if the ambient pressure increases or the temperature of the ink in the reservoirs decreases, air is not drawn into the apertures 26 because capillary passages 21 provide a greater resistance to flow than the foam material. In this case, a small quantity of ink is drawn into reservoir 54 from reservoir 60 through ink passage 76 and the level of ink in reservoir 60 drops. Air is drawn in through opening 30 to replace the ink drawn from reservoir 60.

Although refill opening 30 should not be completely closed until the cartridge is installed, a plug with a small diameter hole through it may be provided for the opening, or the cartridge may be sealed in an airtight plastic bag, to retard or avoid ink evaporation losses.

During shipment and storage, ambient pressure may be maintained at a second or bottom side of reservoir 60 via stand pipe 18, ink passage 20, capillaries 21 and the apertures 26 in nozzle plate 28, thus maintaining a zero pressure differential between the pressures on opposite sides of the ink in reservoir 60 even though the ambient pressure may vary. However, if desired to reduce the possibility of ink leakage during shipment and storage, the apertures 26 may be closed by a tape that is removed before the cartridge is installed in a printing device.

Printers or plotters having an off-carrier ink supply typically have a pinch valve for automatically shutting off ink flow through the supply hose 36 when power is turned off or a cover is opened to gain access to the ink cartridge. This prevents the leakage of ink from the supply hose 36 when the hose is disconnected from a cartridge during replacement of a cartridge that is no longer useable. When the cartridge 10 is to be installed, it is mounted on the cartridge carrier in the usual way. The cover permitting access to the cartridge carrier is opened thus preventing the flow of ink through the supply hose 36. If there is a cartridge already installed, the fittings 32,34 are disconnected and the old cartridge on the cartridge carrier is removed and replaced with a new cartridge 10. The fitting 34 is brought into position so that needle 44 may enter the refill opening 30. As the fittings 32 and 34 are brought together, the needle 44 passes through the air buffer region 58 and is guided by needle guide 68 so that it passes through the pierced septum 66 and into the free ink reservoir 54. The projection 40 on fitting 34 extends into opening 30 to provide a seal as the threads 46 and 48 are engaged and fitting 34 is rotated a part turn to secure it on fitting 32. The access cover to the cartridge carrier is then closed to permit ink flow through the ink supply hose and the cartridge is ready to print.

During printing, ink is drawn from reservoir 60 through passage 20 and ink is sucked from reservoir 54 into reservoir 60 because the top of reservoir 60 is no longer vented through the refill opening 30. As ink is sucked from reservoir 54, the pressure tends to drop thus siphoning replenishment ink from the off-board ink supply 38. Assuming the ink supply hose 36 is full, ink is immediately drawn into reservoir 54 through needle 44. In this case the ink level in reservoir 54 remains substantially constant.

On the other hand, if the supply hose 36 is not completely filled with ink, or has no ink therein as would be the case when the cartridge is installed in a new plotter or printer, the air in the supply hose is sucked into reservoir 54 as ink is sucked from this reservoir into reservoir 60. The level of the ink in reservoir 54 drops and continues to drop during printing until all of the air has been sucked from the supply hose. The ink level in reservoir 54 then stabilizes as replacement ink begins entering the reservoir.

The volume of reservoir 54 must be large enough so that the level of ink in the reservoir never drops to a level below the tip of needle 44 or ink passage 76. That is, the volume of the reservoir must be significantly greater than the volume of the ink supply hose 36. This avoids meniscus effects and keeps air bubbles out of the supply hose 36.

Figure 3:
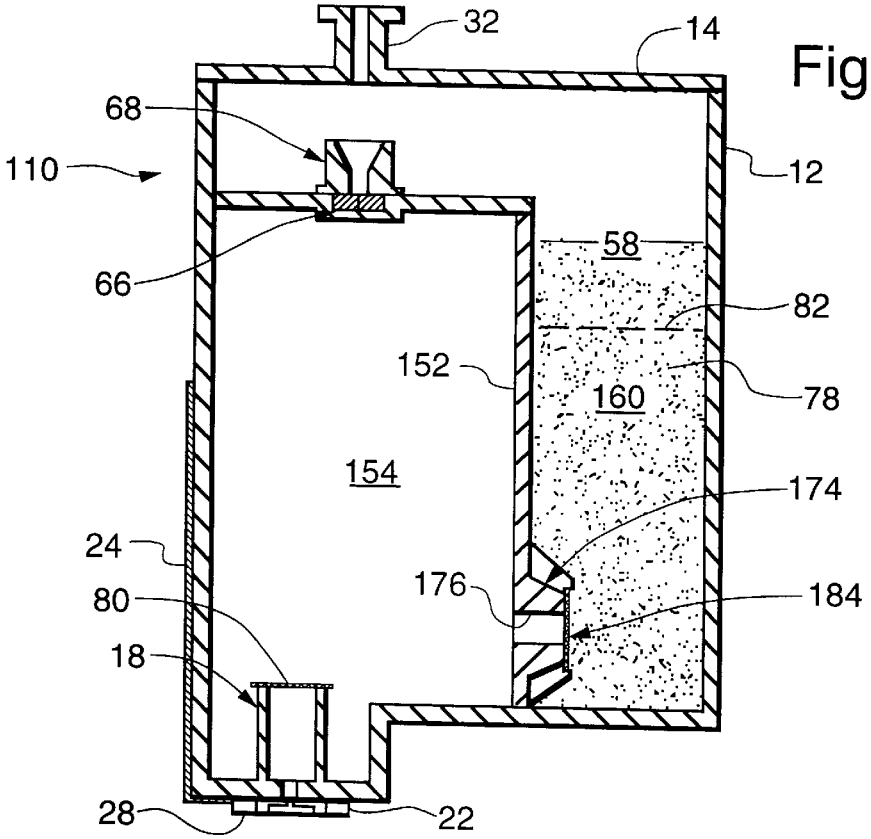
FIG. 3 is a sectional view of a second embodiment wherein ink is drawn directly from a free ink reservoir during printing; and, FIG. 4 is a sectional view of a third embodiment wherein the foam-filled ink reservoir extends only part way of the height of the cartridge.

FIG. 3 illustrates a second embodiment of the invention wherein a cartridge 110 has a stand pipe 18 located in a free ink reservoir 154. A partition 152 separates reservoir 154 from a foam-filled ink reservoir 160. Partition 152 is provided with a boss 174 extending into reservoir 160 and an ink passage 176 in the boss to permit ink flow between the two reservoirs. A filter screen 184 covers ink passage 176 to prevent particles of foam material 78 from migrating into the free ink reservoir. Except for these parts, the cartridge 10 is like cartridge 10 hence like parts have been assigned like reference numerals and will not be further described.

The cartridge 110 is assembled, filled and tested in essentially the same manner as described above with reference to cartridge 10. As long as the refill opening 30 is not closed, cartridge 110 responds to changes in temperature and pressure in the same manner as cartridge 10. That is, the level of ink in the foam-filled reservoir 160 rises or falls because the foam 78 provides a lower resistance to ink flow than the ink capillaries in the heater chip 22. Therefore, ink is not forced out through the apertures in nozzle plate 28 nor is air sucked or forced into the ink capillaries through the apertures as a result of temperature and/or pressure changes.

Cartridge 110 does function differently from cartridge 10 during printing. As the nozzles are fired to eject ink from the cartridge through the apertures, the vacuum occurring as the heaters cool sucks replenishment ink from the free ink reservoir 154. This ink is replaced by ink drawn into reservoir 154 from the off-board ink supply 38 (FIG. 2). That is, ink does not flow through the foam-filled reservoir 160 during printing.

Figure 4:
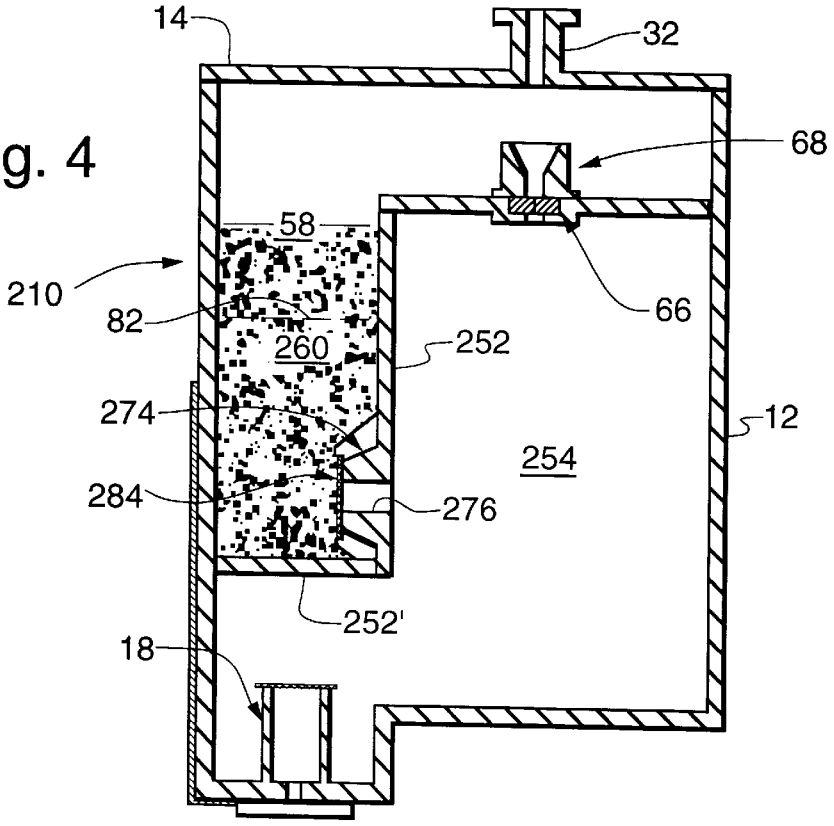

The foam-filled reservoir need not extend the full height of the cartridge if the stand is pipe is located in the free ink reservoir. FIG. 4 illustrates a cartridge 210 where the foam-filled reservoir 260 is located above the stand pipe 18 but extends only part way of the height of the cartridge. In this case, two partitions 252 and 252' are required to separate the free-ink reservoir 254 from the foam-filled reservoir 260. The cartridge 210 functions in exactly the same way as cartridge 110.

For a given size cartridge, the smaller size of the foam-filled reservoir 260 permits a larger quantity of ink to be held in the free ink reservoir 254. However, this advantage is partially offset. Because the ink passage 276 connecting the reservoirs must be positioned at a higher level in the cartridge, and because the ink in the free ink reservoir should always be above the ink passage, there is a larger volume of ink in the free ink reservoir that is unusable in the unlikely event that the off-board ink supply is fully depleted.

From the foregoing description it is seen that the invention, in each of its embodiments, provides a refillable, disposable ink cartridge comprising a hollow body having two interconnected reservoirs for holding an internal ink supply, the body having a refill opening connectable to an external ink supply for replenishing the internal ink supply, the refill opening admitting ambient pressure to an air buffer region in the interior of the body when the refill opening is not closed, the ambient pressure being applied to the ink supply through a dry foam material which provides less resistance to ink flow than the capillaries through which ink flows during printing. A cartridge is provided that may be filled, primed and tested at the factory thus removing from customer personnel the burden of performing these operations. There is no leakage of ink from the cartridge even though the refill opening through which the cartridge is refilled during use is left open during shipment and storage. If it becomes necessary to disconnect the cartridge from the off-carrier ink supply of a printing device, the septum wipes ink from the ink supply needle so that the disconnection may be made cleanly without the spread or smearing of ink. All of these advantages accrue without requiring any modification in the printing device itself.

Although preferred embodiments have been described in detail to illustrate the principles of the invention, it will be understood that various modifications and substitutions may be made in the described embodiments without departing from the spirit and scope of the invention as defined by the appended claims.

We claim:

1. A refillable ink cartridge for an inkjet printing device, said cartridge comprising:

a cartridge body having therein a partitioning means dividing the interior of the cartridge into a free ink reservoir containing free ink, a foam-filled ink reservoir and an air buffer region;

an ink passage in said partitioning means permitting ink flow between the foam-filled ink reservoir and the free ink reservoir in either direction;

said cartridge body having a refill opening therein connecting the air buffer region to ambient environment;

said partitioning means having a hole therein between said free ink reservoir and said air buffer region, said hole being spaced from and axially aligned with said refill opening and closed by a pierceable barrier; and, hydrophobic foam material within said cartridge body, a first portion of the foam material being in said foam-filled ink reservoir and saturated with ink, a second portion of said foam material being dry and positioned in said air buffer region so that ambient pressure is applied to ink in said foam-filled ink reservoir through the dry foam material as long as said refill opening is open.

2. A refillable ink cartridge as claimed in claim 1 wherein said barrier is an elastic septum.

3. A refillable ink cartridge as claimed in claim 1 and further comprising a needle guide for guiding a hollow needle, inserted into said refill opening, through said barrier.

4. A refillable ink cartridge as claimed in claim 1 in combination with means for supplying ink to said free ink reservoir from an external ink supply, said means comprising a hollow needle insertable through said refill opening and said pierceable barrier.

5. A refillable ink jet cartridge as claimed in claim 1 in combination with a hollow needle, a fitting for sealing said refill opening, and an external ink supply connected to said fitting by a flexible hose, said needle being mounted in said fitting and extending into said free ink reservoir through said refill opening and said hole when said fitting seals said refill opening, said fitting having a passage therein permitting a flow of ink from said flexible hose to said needle.

6. A refillable ink cartridge as claimed in claim 1 wherein said cartridge body has a further opening therein for permitting a flow of ink from one of the reservoirs to ink capillaries in an ink-ejecting heater chip secured to an outside surface of the cartridge body, the ink capillaries providing a greater resistance to ink flow than the foam material.

7. A refillable ink cartridge as claimed in claim 6 wherein said further opening opens into a stand pipe disposed in said foam-filled ink reservoir.

8. A refillable ink cartridge as claimed in claim 6 wherein said further opening opens into a stand pipe disposed in said free ink reservoir.

9. A refillable ink cartridge as claimed in claim 8 wherein said foam-filled ink reservoir is disposed above said stand pipe.

10. A continuously refillable ink jet cartridge for a printing device, said cartridge comprising:

a cartridge body having partitions therein dividing the interior of said cartridge body into a free ink reservoir, a foam-filled ink reservoir, and an air buffer region;

said cartridge body having a refill opening therein for admitting ambient pressure to said air buffer region when said refill opening is open, said refill opening being connectable to an external ink supply for supplying ink to said free ink reservoir during printing;

one of said partitions separating said air buffer region from said free ink reservoir and having a hole extending therethrough, said hole being axially aligned with said refill opening so that a hollow ink supply needle may be inserted through said refill opening and said hole and into said free ink reservoir.

11. A continuously refillable ink jet cartridge as claimed in claim 10 wherein said hole is sealed by a pierceable barrier.

12. A continuously refillable ink jet cartridge as claimed in claim 10 wherein said hole is sealed by a rubber septum.

13. A continuously refillable ink jet cartridge as claimed in claim 10 and further comprising a needle guide for guiding a needle into said hole, said needle guide having walls diverging outwardly in the direction of said refill opening.

14. A continuously refillable ink jet cartridge as claimed in claim 13 in combination with a hollow needle, a fitting for sealing said refill opening, and an external ink supply connected to said fitting by a flexible hose, said needle being mounted in said fitting and extending into said free ink reservoir through said refill opening and said hole when said fitting seals said refill opening, said fitting having a passage therein permitting a flow of ink from said flexible hose to said needle.

15. A continuously refillable ink jet cartridge as claimed in claim 10 wherein:

another of said partitions has an ink flow passage therein permitting a flow of ink in either direction between said free ink reservoir and said foam-filled ink reservoir;

a foam material is disposed within said cartridge, a first portion of said foam material being in said foam-filled ink reservoir and saturated with ink, a second portion of said foam material being dry and positioned in said air buffer region so that ambient pressure is applied to ink in said foam-filled ink reservoir through said dry foam material as long as said refill opening is open;

said cartridge body has a further opening therein permitting a flow of ink from one of said reservoirs to ink capillaries of an ink-ejecting chip secured to an outside surface of said cartridge body, said ink capillaries providing a greater resistance to ink flow than said foam material whereby changes in temperature and ambient pressure cause the level of ink in said foam material to rise and fall when said refill opening is open; and, ejection of ink during printing creates a suction in said free ink reservoir to draw ink into said free ink reservoir when said refill opening is connected to said external ink supply.

16. A continuously refillable ink cartridge as claimed in claim 15 and further comprising an air bubble guard, said air bubble guard comprising a boss surrounding said ink flow passage and extending into said free ink reservoir to prevent migration of air bubbles from said free ink reservoir to said foam-filled ink reservoir when said cartridge is oriented such that said foam-filled ink reservoir is above said free ink reservoir.

17. A continuously refillable ink cartridge as claimed in claim 15 wherein said further opening opens into a stand pipe disposed in said foam-filled ink reservoir.

18. A continuously refillable ink cartridge as claimed in claim 15 in combination with means for supplying ink to said free ink reservoir from the external ink supply through said refill opening and said pierceable barrier.

19. A continuously refillable ink cartridge as claimed in claim 15 wherein said further opening opens into a stand pipe disposed in said free ink reservoir.

20. A continuously refillable ink cartridge as claimed in claim 19 wherein said foam-filled ink reservoir is disposed above said stand pipe.

* * * * *